United States Patent [19]

Pfeifer

[11] 4,365,725

[45] Dec. 28, 1982

[54] BASKET WITH SWING AWAY DOUBLE LOCKING HANDLE

[75] Inventor: William Pfeifer, Springdale, Pa.

[73] Assignee: Dravo Corporation, Pittsburgh, Pa.

[21] Appl. No.: 287,710

[22] Filed: Jul. 28, 1981

[51] Int. Cl.[3] ..... B65D 25/28; B65D 25/32

[52] U.S. Cl. ..... 220/96; 220/95; 220/91

[58] Field of Search ..... 220/95, 96, 91, 94 R; 217/125; 229/DIG. 6; 16/110 R, 111 R, 350

[56] References Cited

U.S. PATENT DOCUMENTS 4,215,789 8/1980 Pfeifer ..... 220/95

FOREIGN PATENT DOCUMENTS 305917 3/1955 Fed. Rep. of Germany .... 220/94 R
1166967 11/1958 France ..... 220/96
1070961 6/1967 United Kingdom ..... 220/96

*Primary Examiner*—Allan N. Shoap
*Assistant Examiner*—Robert Petrik
*Attorney, Agent, or Firm*—Parmelee, Miller, Welsh & Kratz

[57] ABSTRACT

A market basket is provided with a U-shaped handle having outwardly projecting locking tabs. The locking tabs, each comprised of a support bar and a locking bar, are slidably and rotatably received in vertical slots in the side walls of the basket. With the locking tab at the bottom of the side wall slots, the handle is freely rotatable. When the handle is lifted upwardly while in the vertical position, each of the locking bar enters into and engages a second vertical slot provided by a locking block to prevent the handle from rotating, the locking block being located on a flange which depends downwardly from an outwardly extending lateral rim on the upper edge of the basket. In an alternate embodiment, the support bar has cross arms forming a cruciform cross sectional shape which engage the correspondingly shaped top of the sidewall slot providing three support points and additional handle locking action. In another embodiment, an outwardly directed offset is provided in the side walls below the side wall slots to furnish a storage ledge for the handle when it is in a horizontal or stowed position. A further embodiment utilizes a retention button intermediate the locking bar and support bar and positioned between the side wall and flange. The button is sized to be larger than the width of the side wall slots; thus, inhibiting removal of the handle from the basket once the handle and basket are assembled.

10 Claims, 7 Drawing Figures

BASKET WITH SWING AWAY DOUBLE LOCKING HANDLE

BACKGROUND OF THE INVENTION

1. Field of the Invention

This invention relates to a basket and handle combination in which the handle is locked in the vertical position when raised and automatically rotates to a generally horizontal stowed positioned when released.

2. Prior Art

It is common practice to provide customers of self-service retail stores with hand-held baskets for carrying small pieces of merchandise. Generally, these baskets are elongated and provided with one or two metal or plastic free swiveling U-shaped handles which straddle the basket and are pivotally connected near the mid-points of the long sides of the baskets. The handles of such baskets pivot when released to a stowed position which facilitates stacking of the baskets. However, with these free swiveling handles, there is a tendency for the basket to tip and possibly spill the contents if a heavy object is placed in one end of the basket or the load shifts while the basket is being carried by the handle.

Some attempts have been made to provide a handle on these merchandise baskets which can easily be rotated to a stowed position but which can be locked in a vertical position when raised. Accordingly, wire baskets have been made in which loops at the ends of the legs of the wire handles slide upward in slots in the sides of the baskets when the handle is lifted to engage a recess either in the wire forming the top edge of the basket or in a metal plate welded to the top edge wire. A plastic basket has also been produced in which each leg of the handle is inserted between two spaced, upwardly directed planar members on the side of the basket. A necked outward projection on the outside of the leg slides vertically and rotates in a vertical slot in the outer member, while an inward projection on the end of the leg engages a groove in the inside member when the handle is raised. In U.S. Pat. No. 4,215,789, another type of handle locking mechanism utilizes a handle with inwardly projecting feet and vertical slots in the sidewalls of the basket and open-end notches in the downwardly depending flanges of the rim of the basket. The foot has a necked down portion which is rotatably and slidably received in the slot allowing the handle to be rotated between a horizontal and a vertical position. When the handle is lifted up while in the vertical position, the neck portion slides up the slot and the remaining section of the foot engages the notch to prevent rotation of the handle. Upon release of the handle, the feet drop out of the notch and the handle freely rotates to a stowed position outside of the basket.

SUMMARY OF THE INVENTION

According to the invention, the top edge of a merchandise basket is provided with a laterally outwardly extending rim which terminates in a downwardly directed flange spaced from the side of the basket. A locking means is supported by the basket and preferably is provided on the inner surface of the flange and extends toward the side wall. The locking means has a downwardly open vertical slot which is aligned with another vertical slot located beneath the upper edge in the side wall of the basket. A U-shaped handle having two legs depending from a hand grasping base portion is positioned between the sides of the basket. Opposed locking tabs project outwardly away from each other from the free ends of the legs. Each tab is comprised of a support bar located adjacent to the leg and a locking bar positioned adjacent to the support bar. The support bars are rotatably and slidably received into the vertical slot in the side wall. Each locking bar has a flat side parallel to a plane formed by the legs of the handle and is dimensioned to be closely fitting and slidable within the slot provided in the locking means. The flat side of the locking bar provides additional contact area with the slot in the locking means. When the support bar is at the lower end of this slot, the handle may be rotated from a stowed, generally horizontal, position inside the basket to a vertical position. When the handle is lifted up while in the vertical position, the locking bar enters the open end of the slot in the locking means and engages with the slot to prevent rotation of the handle. When the handle is released, the locking bar can slide or be urged downward out of the slot allowing the handle to freely rotate into its stowed position.

In an alternate embodiment the support portion has a non-circular cross-section, preferably cruciform, and the upper end of the side wall slot is shaped to correspond to this cross-section. When the handle is lifted up, while in the vertical position the support bar engages the upper end of the sidewall slot to provide additional locking action preventing rotation of the handle as well as support. With either embodiment it is preferable that both the support bar and locking bar engage the top of the slots in the sidewall and locking means, respectively. This arrangement provides for two support points on each locking tab to better distribute the weight of the basket and its contents.

In another embodiment of the invention a retention button is provided on each locking tab intermediate the support bar and the locking bar. This button is positioned between the side wall and the flange and is of a size larger than the width of the slot in the side wall. This prevents the handle from being pulled out of the side wall during normal use. The button is placed in position by deforming the resilient material used in the side wall. Preferably, the edge of the button is leveled or tapered in order to facilitate its passage through the side wall slot. Also the use of walls extending transversely between the outer surface of the side wall and the inner surface of the flange on either side of the locking means is desirable in order to provide rigidity. As another aspect of the invention, an outwardly extending offset is provided in the side wall for holding the handle when it is placed in the stowed position. The offset is positioned below the upper edge and the side wall slot at a distance from the upper edge so that the legs and base of the handle when placed in their horizontal position will not extend beyond the plane formed by the rim of the basket. This arrangement creates a neater and more attractive appearance and allows for better stacking than those of the prior art.

DETAILED DESCRIPTION

Figure 1:
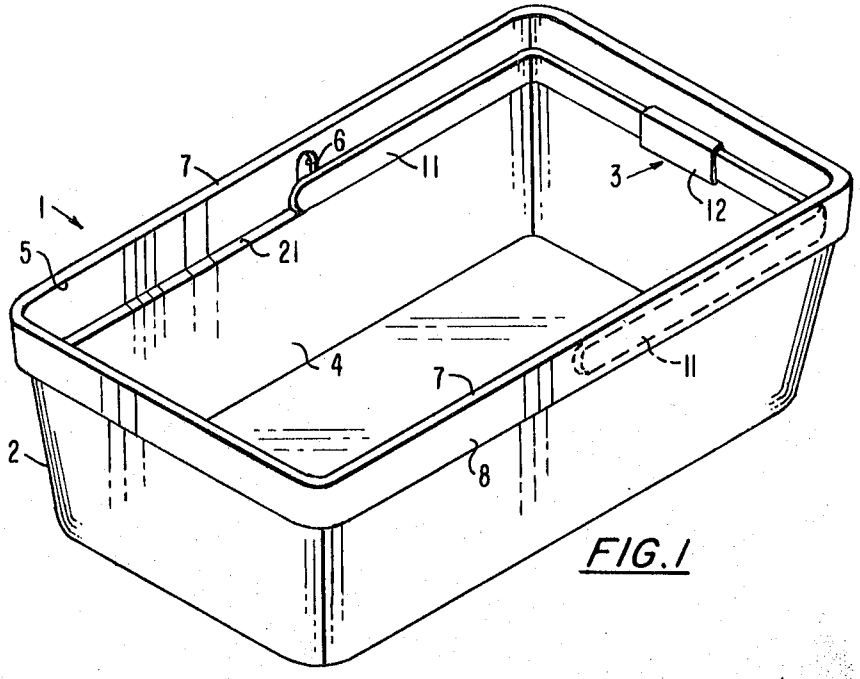
FIG. 1 is an isometric view of a merchandise basket incorporating the invention and showing the handle in the stowed position.
Figure 2:
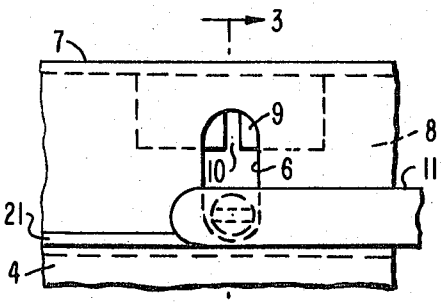
FIG. 2 is a elevational view of the side of the basket taken from inside of the basket showing the means for attaching the handle to the basket and showing the handle in the stowed position.

The basket and handle combination 1 as shown in FIGS. 1 and 2 comprises a basket 2 and a U-shaped handle 3 between the sidewalls 4 of interior opening of the basket 2 which can be locked into a vertical position by lifting up on the handle 3 and which automatically unlocks and rotates to a stowed horizontal position when released. The side walls 4 of the basket 2 each have an upper edge 5 and a first vertically disposed slot 6 located beneath the upper edge 5. A rim 7 extends laterally outward from the upper edge 5 and terminates in a downwardly directed flange 8, which is spaced apart from the side wall 4 and supports a locking means 9. The locking means 9 is positioned opposite the first slot 6 and has a second vertically disposed slot 10 with an open lower end. This second slot 10 is horizontally aligned with the first slot 6.

The preferred form of the locking means 9 is a block extending laterally inward from the inner surface of the flange 8 toward the outer surface of the sidewall 4. This locking block defines the second slot 10 which can be positioned in the flange 8 and can extend therethrough. However, the locking block is preferred in that more contact area with the locking bar is provided for preventing handle rotation and supporting the weight of the basket. Also, the locking block provides additional rigidity in that portion of the rim 7 and flange 8 adjacent the handle 3. The locking block can be formed as a part of the rim/flange assembly or it can be inserted after the rim/flange assembly is formed, the former construction being preferred.

Figure 3:
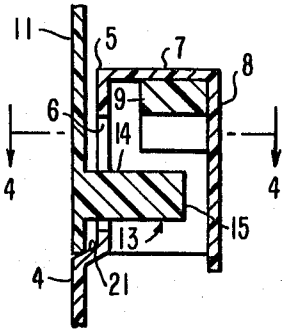
FIG. 3 is a cross-sectional elevation of the means for attaching the handle to the basket taken along line 3—3 of FIG. 2 showing the handle in the vertical position.
Figure 4:
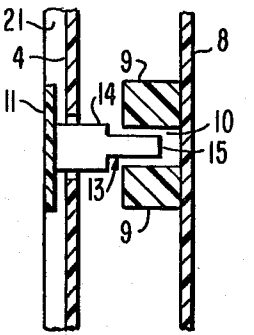
FIG. 4 is a cross-sectional plan view of the handle and basket taken along line 4—4 of FIG. 3 showing a locking bar and locking means.

The U-shaped handle 3 comprises two substantially parallel legs 11 depending from the opposite ends of a hand grasping base portion 12 with the free ends of the legs 11 terminating in outwardly directed locking tabs 13. Each tab is comprised of a support bar 14 adjacent the leg 11 and a locking bar 15 axially aligned with the support bar 14. The support bars 14 are slidably and rotatably received in the first slots 6 in the side walls 4. The length of these slots 6 is such that with the support bars 14 of the locking tabs 13 on the legs 11 located at the bottom of the first slots 6 (see FIGS. 3 or 5) the handle 3 can be freely rotated between a generally horizontal and vertical positions. The locking bar 15 has a flat side parallel to a plane formed by the legs 11 of the handle 3 and is dimensioned so that it is closely fitting and slidable within the second slot 10. The flat side of the locking bar 15 provides additional contact area with the second slot 10. When the handle 3 is lifted upwardly while in the vertical position, the locking bars 15 enter the open end of the second vertical slots 10 to prevent rotation of the handle 3 while the support bars 14 slide upwardly in the first slots 6. Preferably, the first slots 6 and the second slots 10 are so dimensioned vertically that the support bars 14 engage the tops of the first slots 6 and the locking bars 15 engage the tops of the second slots 10 in order to distribute the load of each locking tab 13 and leg 11 between these contact points. Upon release of the handle 3, the locking bars 15 drop out of the second slots 10 while the support bars 14 slide to the bottom of the first slots 6 allowing the handle 3 to freely rotate back to a stowed position.

Figure 5:
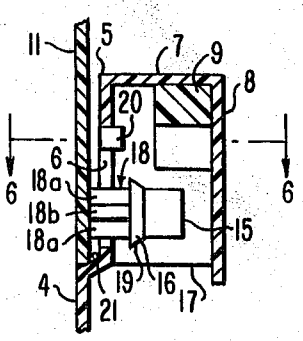
FIG. 5 is a cross-sectional elevation of an alternate means for attaching the handle to the basket taken along line 3—3 of FIG. 2 with the handle in a vertical position showing the retention button, cruciform support bar, transverse wall members and the sidewall offset.
Figure 6:
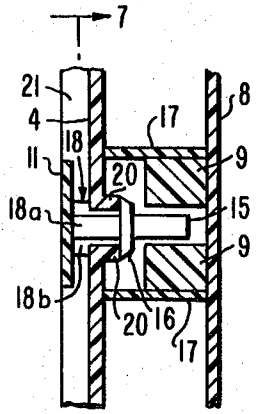
FIG. 6 is a cross-sectional plan view of the handle and basket taken along line 6—6 of FIG. 5 showing a cruciform support bar and correspondingly shaped sidewall slot and sidewall ribs.
Figure 7:
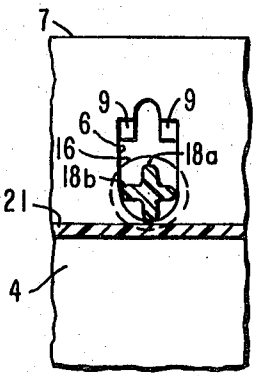
FIG. 7 is a cross-sectional elevational view of the handle and basket taken along line 7—7 of FIG. 6 showing the cruciform support bar and correspondingly shaped side wall slot the top of which engages the support bar when the handle is lifted while in the vertical position.

In FIGS. 5, 6 and 7 the use of a retention button 16, wall members 17 and a support bar having a non-circular cross section is shown. The retention button 16 is intermediate the support bar 18 and locking bar 15 and is positioned between the side wall 4 of the basket 2 and the flange 8. The button 16 is of a size greater than the width of the first vertical slot 6. The button 16 inhibits the removal of the locking tabs from the slots and its use is not dependent on the forms of the support or locking bars which are utilized in the locking tab. When used, it is preferable that the edge of the button have a bevel 19 such that the outer side of the button is about the width of the first slot. The bevel 19 helps to reduce the force required to insert the locking tab through the first slot 6. The wall members 17, which extends transversely between the inner surface of the flange 8 and the outer surface of the side wall 4 and are positioned on either side of the locking means 9 and the first slot 6 are utilized to provide additional rigidity in this area of the basket.

An additional locking means can be provided by using a support bar 18 having a non-circular cross-section together with the top the first slot 6 being correspondingly shaped to match this cross section when the handle is in the vertical position. When the handle is raised while in the vertical position, the support bar 18 engages the top of the first slot providing additional locking action. Preferably, the support bar has cross arms **18*a*, 18*b* forming a cruciform cross sectional shape, as illustrated in FIGS. 5 and 6, with the cross arms being oriented on the locking tab such that when the handle is in a vertical position the cruciform support bar cross arms 18*a*, 18*b* are be positioned in substantially vertical and horizontal directions, respectively. The cruciform support bar is dimensioned such that supplemental locking action as well as support is provided when the support bar engages the top of a correspondingly shaped first slot 6. In addition outwardly projecting side wall ribs 20, can be provided on the outer surface of the side wall about either side of the first slot and adjacent the top thereof. These ribs 20 are dimensioned such that when the cruciform support bar engages the top of the first slot 6 the bottom end of each rib 20 contacts the horizontal cross arm 18*b* of the cruciform support bar 18 while the vertical cross arm 18*a* slidably engages with the side wall ribs 20. The use of the ribs 20 provides further additional locking action and support for the handle 11. The ribs 20 are also dimensioned so as not to interfere with the vertical motion of the retention button 16 when the handle is being raised and/or rotated. Various non-circular cross sectional shapes, e.g., square or star, can be used for the support bar 18. However, they must be sized so that the handle can still be freely rotated between the stowed and vertical positions, i.e., the maximum cross sectional dimension should not exceed the width of the lower end of first slot 6**.

An offset 21 for stowing the handle can be provided in the side wall 4 of the basket 2. The offset 21 is positioned beneath the upper edge 5 and first slot 6 and extends laterally outward from the side wall 4. The distance at which the offset 21 is located beneath the upper edge is such that when the handle 3 is in the horizontal or stowed position the legs 11 and base 12 of the handle 3 will not extend upwardly beyond the rim 7 of the basket 2. The offset 21 prevents the handle 3 from rotating to a position at the bottom of the basket, a position which can interfere with the stacking or nesting of the baskets.

The basket and handle may be molded from a plastic such as impact styrene or other suitable material and is assembled by deforming the first slots 6 in the side wall 4 and inserting the locking tabs 13 therethrough.

I claim:

1. A basket and a U-shaped handle extending across the basket which can be locked into a vertical position by lifting up on the handle and which can be unlocked and rotated to a stowed position when released comprising:

the basket having side walls, each side wall having an upper edge and a first vertically disposed slot therethrough, located beneath the upper edge;

a locking means supported by the basket and positioned opposite the first slot and having a second vertically disposed slot with an open lower end, the second slot being horizontally aligned with the first slot;

the U-shaped handle comprising two substantially parallel legs depending from opposite ends of a hand grasping base portion, the free ends of the legs terminating in outwardly directed locking tabs, each locking tab comprising a support bar adjacent the respective leg and a locking bar axially aligned with the support bar, the locking bar having a flat side oriented parallel to a plane formed by the legs of the handle and being slidable within and closely fitting with the second slot, the support bar being slidably and rotatably received in the first slot in the side wall of the respective basket, the first vertical slots being of such a length that with the support bars of the locking tabs on the legs located at the bottom of the first slots the handle can be rotated between a generally horizontal position and a vertical position and such that when the handle is lifted while in the vertical position the locking bars enter the open ends of the second vertical slots in the locking means providing locking action to prevent rotation of the handle, the flat sides of the locking bars furnishing additional contact area with the second vertical slots.

2. The basket and handle as described in claims 1 wherein the support bars have a non-circular cross-sectional shape and the upper ends of the first slots in the side walls are correspondingly shaped to match the cross sectional shape of the support bars when the handle is lifted up while in the vertical position such that the support bars engage with the upper ends of the first slots to provide additional load support and locking action to prevent rotation of the handle.

3. The basket and handle as described in claim 2 wherein the support bars each have cross arms forming a cruciform cross sectional shape oriented on the locking tab such that when the handle is in a vertical position the cross arms of each of the cruciform support are oriented in a substantially vertical and horizontal direction, the cruciform support bars being dimensioned such that three contact points are formed with the top of the first slot to provide an additional locking action.

4. The basket and handle of claim 3 including outwardly projecting side wall ribs on the outer surface of the side wall, positioned about either side of each of the first slots and adjacent the top portion thereof, each rib being dimensioned such that when the cruciform support bar engages the top of the first slot the horizontal cross arm thereof engages the bottom of each rib and the vertical cross arm thereof is slidably engaged between the ribs.

5. The basket and handle of claims 1, 2, 3 or 4 wherein the first slots and the second slots are so dimensioned vertically that the support bars engage the tops of the first slots and the locking bars engage the tops of the second slots when the handle is lifted to distribute the load between these two contact points for each leg of the handle.

6. The basket and handle of claim 5 wherein the basket includes a rim extending laterally outward from the upper edge of each side wall and terminating in a downwardly directed flange, the flange being spaced apart from the side wall and supporting the locking means.

7. The basket and handle of claim 6 wherein the locking means further comprises a locking block positioned on the inner side of the flange extending laterally inwardly toward the side wall and having the second open end vertical slot therein, the locking block providing additional ridgity to the flange and rim of the basket.

8. The basket and handle as described in claim 7 wherein a retention button is located intermediate the support bar and locking bar of the locking tab and is positioned between the side wall of the basket and the flange, the button being of a size greater than the width of the first vertical slot so as to inhibit the removal of the locking tabs from the first slots.

9. The basket and handle of claim 8 including wall members extending transversely between the flange and the side of the basket adjacent each side of each locking block.

10. The basket and handle of claim 9 wherein the side walls each have an offset portion extending in a substantially laterally outward direction from the side wall, the offset being positioned beneath the first slot and at a distance below the upper edge of the side wall such that when the handle is in the stowed horizontal position the legs and base of the handle rest on the offset and do not extend upwardly beyond the plane formed by the rim of the basket.

* * * * *

UNITED STATES PATENT OFFICE

CERTIFICATE OF CORRECTION

PATENT NO. : 4,365,725

DATED : December 28, 1982

INVENTOR(S) : William Pfeifer

It is certified that error appears in the above-identified patent and that said Letters Patent are hereby corrected as shown below:

On the title page, the name of the assignee should be changed to --Armstrong Store Fixture Corporation--.

Signed and Sealed this

*Twenty-ninth* Day of *March 1983*

[SEAL]

*Attest:*

GERALD J. MOSSINGHOFF

*Attesting Officer*

*Commissioner of Patents and Trademarks*